US005224612A

United States Patent [19]

Shirley

[11] Patent Number: 5,224,612

[45] Date of Patent: Jul. 6, 1993

[54] PORTABLE CRANE

[76] Inventor: Kirk B. Shirley, 2705 Bay Meadow Cir., Dallas, Tex. 75234

[21] Appl. No.: 879,813

[22] Filed: May 7, 1992

[51] Int. Cl.[5] ..... B66C 23/78

[52] U.S. Cl. ..... 212/187; 212/189; 212/265

[58] Field of Search ..... 212/175, 177, 182, 187, 212/189, 255, 265, 142.1; 414/496, 563, 680, 742; 254/2 R, 4 R

[56] References Cited

U.S. PATENT DOCUMENTS

| | | | |
|---|---|---|---|
| 1,958,824 | 5/1934 | Jones | 212/255 |
| 2,375,799 | 5/1945 | Tourneau | 212/187 |
| 2,675,209 | 4/1954 | Freed | 212/187 |
| 2,879,902 | 3/1959 | Wilcox | 212/187 |
| 3,310,291 | 3/1967 | Wiggins | 254/173 |
| 3,794,296 | 2/1974 | Hasstedt | 212/189 |
| 4,049,238 | 9/1977 | Brown | 254/139.1 |
| 4,050,587 | 9/1977 | Moen | 212/59 R |
| 4,135,627 | 1/1979 | McInerney | 212/187 |
| 4,503,983 | 3/1985 | Lew | 212/187 |
| 4,730,742 | 3/1988 | Feterl | 212/142.1 |
| 4,782,962 | 11/1988 | Hackworth et al. | 212/265 |

FOREIGN PATENT DOCUMENTS

| | | | |
|---|---|---|---|
| 500053 | 12/1950 | Belgium . | |
| 752222 | 2/1967 | Canada | 212/189 |
| 185234 | 4/1907 | Fed. Rep. of Germany . | |
| 553324 | 6/1922 | France . | |
| 941076 | 11/1963 | United Kingdom . | |

*Primary Examiner*—Jesûs D. Sotelo
*Assistant Examiner*—Stephen P. Avila
*Attorney, Agent, or Firm*—Howison, Clapp & Korn Ross

[57] ABSTRACT

A portable crane operable between a first, extended position for lifting loads and a second, collapsed position for transportation includes a handle having first and second ends. A boom having first and second ends is provided such that the first end is pivotally interconnected to the first end of the handle. The boom extends outwardly from the first end of the handle in the crane first position and is disposed parallel to the handle in the crane second position. Structure is provided for supporting the handle first end and extends in a direction opposite the boom in the crane first position. The supporting structure is disposed generally parallel to the handle in the crane second position. A cable extends between the handle second end and the boom second end for receiving loads, such that as the cable is retracted, loads are lifted toward the boom second end.

19 Claims, 3 Drawing Sheets

10
12
12a
12b
14
16
18
18a
18b
18c
20
24
28
30
30a
30b
32
34
36
38
40
42
42a
42b
48
50
52
56
62
64
66
68
70
72
80
82

PORTABLE CRANE

TECHNICAL FIELD OF THE INVENTION

This invention relates to a hoisting machine, and more particularly to an improved mechanism for manually hoisting and maneuvering heavy and bulky objects onto a rooftop.

BACKGROUND OF THE INVENTION

Heretofore, a number of improvements for machines capable of lifting heavy objects onto rooftops have been proposed. However, such mechanisms have had limited load capacity, limited lifting height, have been overly mechanized, and required large amounts of access. These machines require special installation or extensive setup and operation, and are expensive.

A need has thus arisen for a practical mechanism suitable for hoisting a heavy, bulky object, such as for example, an air conditioner condensing unit onto a roof, without the need for special installation or a heavy counterweight. Such a mechanism requires good reliability, reduced costs of operation and easy setup. Additionally, a need has arisen for a mechanism that can be carried up a ladder and set up by the operator. A need has still further arisen for a mechanism which can maneuver the load to its required position once it has been raised.

Still another need has further arisen for a machine that can lift and maneuver heavy and bulky loads in highly inaccessible areas on the ground and inside buildings. For example, to bypass circular staircases or maneuver large trees over turf.

SUMMARY OF THE INVENTION

In accordance with the present invention, a portable crane operable between a first, extended position for lifting loads and a second, collapsed position for transportation, is provided. The crane includes a handle having first and second ends. A boom having first and second ends is provided such that the first end is pivotally interconnected to the first end of the handle. The boom extends outwardly from the first end of the handle in the crane first position and is disposed parallel to the handle in the crane second position. Structure is provided for supporting the handle first end and extends in a direction opposite the boom in the crane first position. The supporting structure is disposed generally parallel to the handle in the crane second position. A cable extends between the handle second end and the boom second end for receiving loads, such that as the cable is retracted, loads are lifted toward the boom second end.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figures 1, 2:
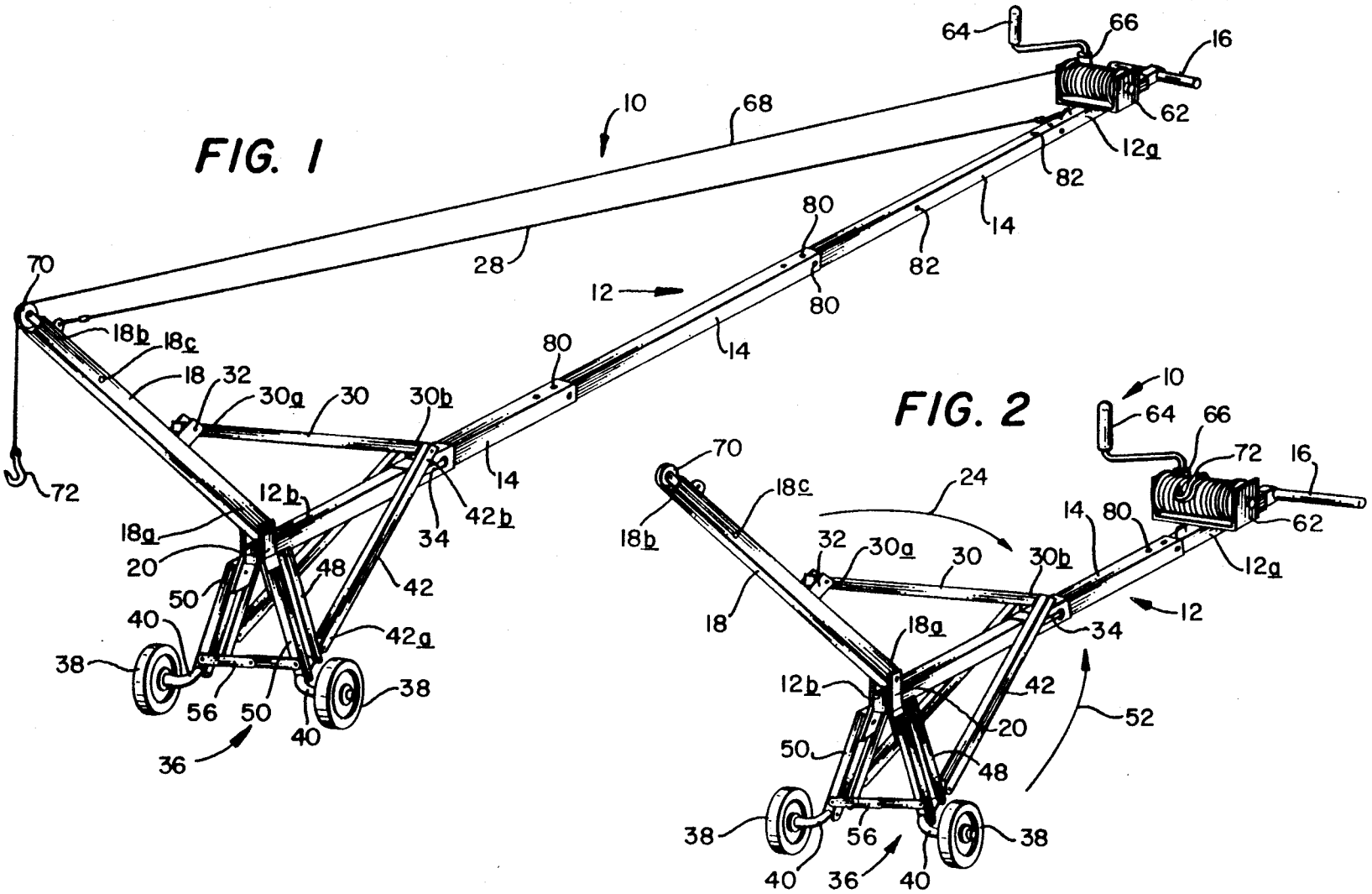
FIG. 1 is perspective view of the present portable crane in the extended position.
FIG. 2 is a perspective view of the present portable crane shown in FIG. 1 in a partially collapsed position.
Figure 3:
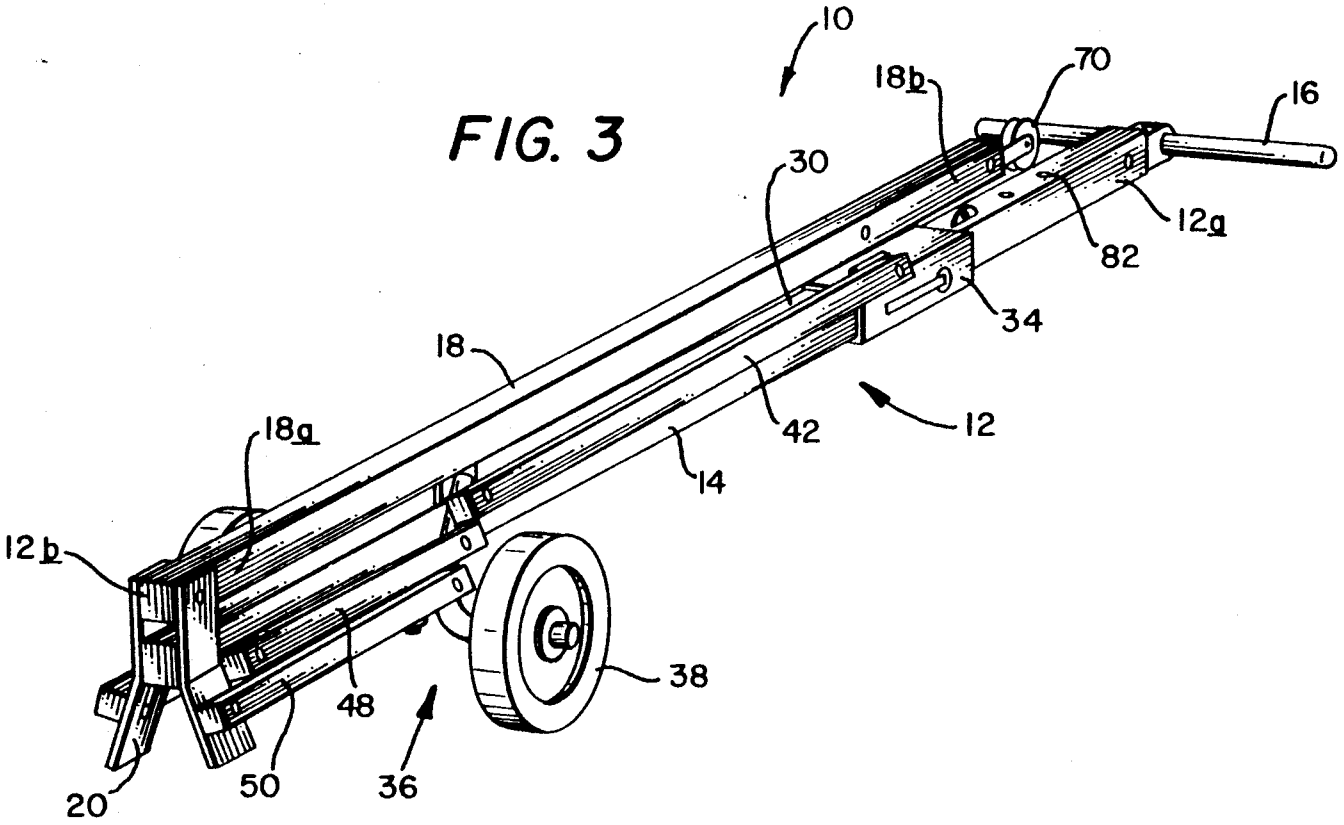
FIG. 3 is a perspective view of the present portable crane shown in FIG. 1 in the fully collapsed position.

Referring simultaneously to FIGS. 1, 2, and 3, the present portable crane is illustrated, and is generally identified by the numeral 10. FIG. 1 illustrates crane 10 in its fully extended position for operation. FIGS. 2 and 3 illustrate portable crane 10 in an intermediate and fully collapsed positions for transportation. Portable crane 10 includes a collapsible handle 12 having ends 12*a* and 12*b*. Handle 12 may include, for example, a plurality of telescoping sections 14 which are illustrated in FIG. 1 as being fully extended and collapsed in FIGS. 2 and 3. End 12*a* of handle 12 includes a grip 16.

Pivotally interconnected to end 12*b* of handle 12 is a boom 18 having ends 18*a* and 18*b*. Disposed adjacent end 18*b* is an aperture 18*c*, whose function will be subsequently described with respect to FIG. 5. End 18*a* is pivotally interconnected to end 12*b* of handle 12 through a bracket 20. Boom 18 pivots between the extended position as illustrated in FIG. 1 to a retracted position, by rotating in the direction of arrow 24 (FIG. 2) to the fully retracted position, parallel to handle 12, as shown in FIG. 3.

Interconnected between end 12*b* of handle 12 and end 18*b* of boom 18 is a guy cable 28. Also interconnected between handle 12 and boom 18 is a brace member 30 having ends 30*a* and 30*b*. End 30*a* of brace member 30 is pivotally interconnected intermediate of ends 18*a* and 18*b* of boom 18 using a bracket 32. End 30*b* of brace member 30 is slidably interconnected to handle 12 utilizing a collar 34. Brace member 30 minimizes bending moments generated within portable crane 10 and prevents these bending moments from being introduced into handle 12.

Portable crane 10 further includes an undercarriage, generally identified by the numeral 36, which is interconnected to end 12*b* of handle 12.

Undercarriage 36 allows portable crane 10 to be easily transported in both the extended position as illustrated in FIG. 1 and the fully collapsed position as illustrated in FIG. 3. Undercarriage 36 includes a pair of wheels 38. Wheels 38 are mounted on axles 40 which are interconnected to hinged braces 42. Braces 42 include ends 42*a* and 42*b*. End 42*b* is pivotally interconnected to collar 34. End 42*a* in hinged to axle 40 to allow brace 42 to pivot such that end 42*a* lies adjacent to end 12*b* of handle 12 in the fully collapsed position of portable crane 10 as illustrated in FIG. 3. Axles 40 of wheels 38 are also interconnected to end 12*b* of handle 12 using two pair of braces 48 and 50. Braces 48 extend between axle 40 and end 12*b* of handle 12. Braces 50 extend between axle 40 and bracket 20. Both pair of brackets 48 and 50 are pivotally interconnected such that undercarriage 36 is collapsible in the direction of arrow 52 (FIG. 2) to allow undercarriage 36 to lie parallel to handle 12 in the fully collapsed position as illustrated in FIG. 3.

Interconnected between brackets 50 is a brace 56. Brace 56 is hinged intermediate its ends and prevents wheels 38 from spreading outwardly. Brace 56 is foldable to allow wheels 38 to lie adjacent the sides of handle 12 in the fully collapsed position of portable crane 10 as illustrated in FIG. 3.

Portable crane 10 further includes a winch 62 mounted to end 12*a* of handle 12. Winch 62 may be hand or mechanically operated through the use of a hand operated handle 64 or drill inserted through an adaptor 66. Winch 62 includes a cable 68 which extends over a pulley 70 interconnected to end 18*b* of boom 18. Cable 68 includes a hook 72 which is received by a load.

In operation of portable crane 10, handle telescoping sections 14 of handle 12 are telescoped outwardly from the position shown in FIG. 3 to the fully extended position as shown in FIG. 1. Sections 14 are secured in the extended position utilizing spring loaded pins 80 which are received in apertures 82. Once handle 12 is fully extended, guy cable 28 is positioned between end 12*b* of handle 12 and end 18*b* of boom 18. Subsequently, boom 18 and undercarriage 36 are positioned by sliding collar 34 toward end 12*b* of handle 12 by utilizing wince 62 to pull end 18*b* of boom 18 toward end 12*b* of handle 12. In operation of portable crane 10, wheels 38 are chocked and end 12*b* of handle 12 at grip 16 may be secured to a stable structure. Winch 62 is unspooled and hook 72 is attached to a load. Next, the operator either stands on grip 16 or holds grip 16 at waist level. Winch 62 is then spooled either manually or by using a drill motor via adaptor 66. Once the load has been winched up into place, portable crane 10 and the load can be driven or manually maneuvered into place by the operator.

Figures 4, 5:
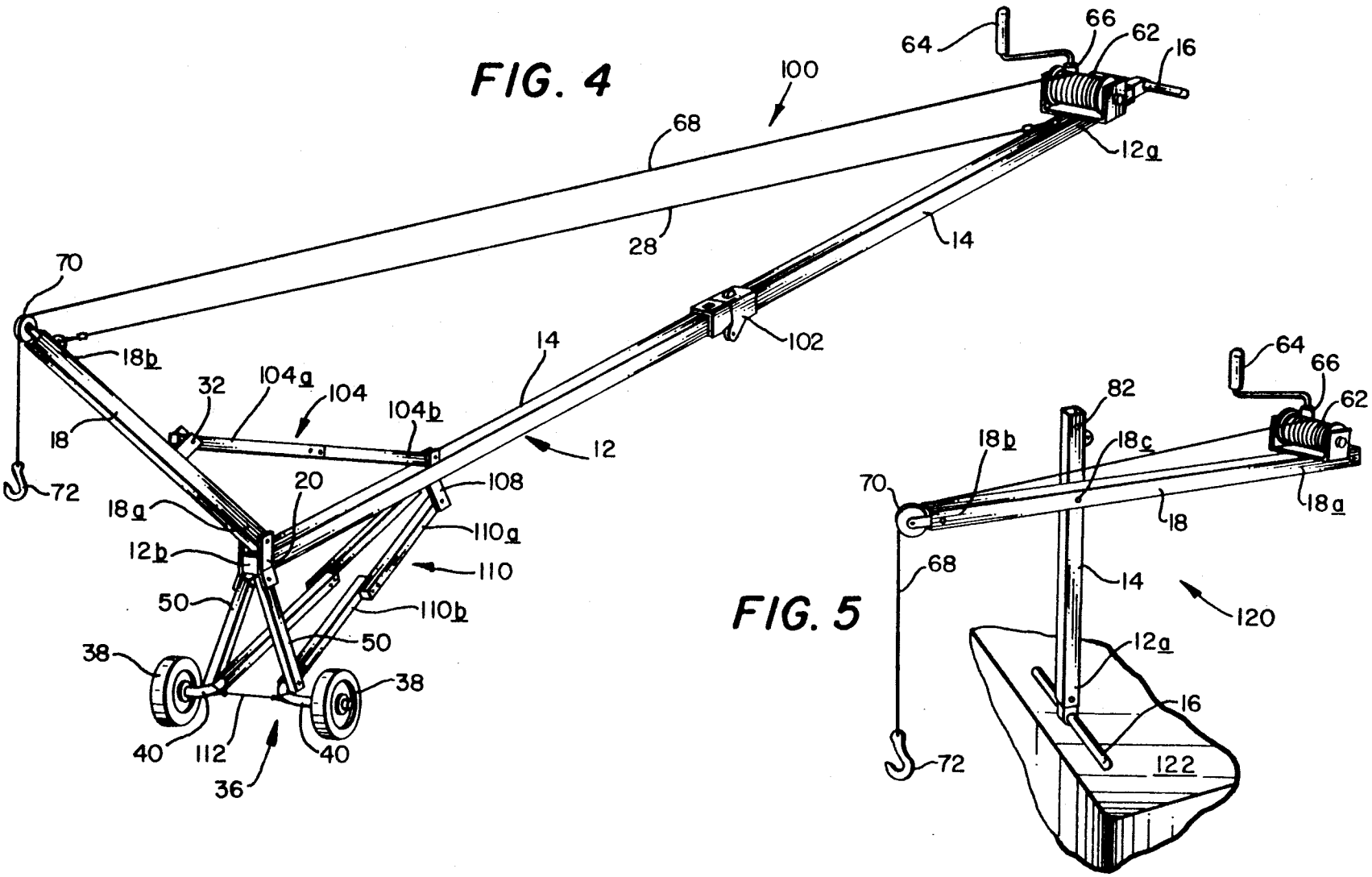
FIG. 4 is a perspective view of a second embodiment of the present portable crane.
FIG. 5 is a perspective view of a third embodiment of the present portable crane.

Referring to FIG. 4, an alternate embodiment of portable crane 10 is illustrated, and is generally identified by the numeral 100, wherein like numerals are utilized for like and corresponding components previously identified with respect to FIGS. 1–3. Portable crane 100 includes handle 12 composed of two 2 sections 14 which are hingedly interconnected utilizing a hinge 102. A brace member 104 interconnects intermediate of boom 18 and handle 12, and is composed of two pivotally interconnected sections 104*a* and 104*b*. Section 104*a* is interconnected to boom 18 utilizing bracket 32. Section 104*b* is interconnected to handle 12 utilizing a bracket 32.

Undercarriage 36 of portable crane 100 includes a pair of supports 110 having members 110*a* and 110*b*. Member 110*b* is interconnected to axle 40 of wheel 38. Member 110*a* is interconnected to bracket 108. Axles 40 are interconnected utilizing a cable 112 to maintain wheels 38 from spreading. Portable crane 100 operates in a similar manner as portable crane 10 and folds to a collapsed position similar to that illustrated in FIG. 3.

Referring now simultaneously to FIGS. 1 and 5, an additional use for the present portable crane 10 will now be described. FIG. 5 illustrates the use of a crane 120 assembled utilizing a handle telescoping member 14 and boom 18. Boom 18 is removed from end 12*b* of handle 12 of portable crane 10, and is used as the horizontal member of crane 120. Winch 62 is removed from end 12*b* of handle 12 and is installed on end 18*a* of boom 18. A member 14 is used as the vertical support of crane 120 and is interconnected through aperture 18*c* of boom 18. Crane 120 is easily carried by a person up a ladder. Crane 120 may also be utilized by a single operator to lift the other components of portable crane 10 to a roof for further use. In operation of crane 120, an operator holds end 18*a* of boom 18 to operate winch 62. Member 14 is supported using grip 16 on a support 122 such as, for example, a roof top.

It therefore can be seen that the present invention provides for a portable crane that can be configured into either a lightweight or full strength crane. Both systems are simple in operation, portable, maintenance free, and require minimum personnel to operate. The present invention exhibits improved reliability as well as reduced cost of operation over previously developed crane systems.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A portable crane operable between a first, extended position for lifting loads and a second, collapsed position for transportation, comprising:

a handle having first and second ends and including a plurality of telescoping members operable between an extended position in the crane first position and a retracted position in the crane second position;

a boom having first and second ends, said first end being pivotally interconnected to said first end of said handle and extending outwardly from said first end of said handle in the crane first position and being disposed parallel to said handle in the crane second position;

means for supporting said handle first end and extending opposite said boom in the crane first position and disposed generally parallel to said handle in the crane second position; and a cable extending between said handle second end and said boom second end for receiving loads, such that as said cable is retracted, loads are lifted toward said boom second end.

2. A portable crane operable between a first, extended position for lifting loads and a second, collapsed position for transportation, comprising:

a handle having first and second ends and including a plurality of hinged members operable between an unfolded position in the crane first position and a folded position in the crane second position;

a boom having first and second ends, said first end being pivotally interconnected to said first end of said handle and extending outwardly from said first end of said handle in the crane first position and being disposed parallel to said handle in the crane second position;

means for supporting said handle first end and extending opposite said boom in the crane first position and disposed generally parallel to said handle in the crane second position; and a cable extending between said handle second end and said boom second end for receiving loads, such that as said cable is retracted, loads are lifted toward said boom second end.

3. A portable crane operable between a first, extended position for lifting loads and a second, collapsed position for transportation, comprising:

a handle having first and second ends;

a boom having first and second ends, said first end being pivotally interconnected to said first end of said handle and extending outwardly from said first end of said handle in the crane first position and being disposed parallel to said handle in the crane second position;

means for supporting said handle first end and extending opposite said boom in the crane first position and disposed generally parallel to said handle in the crane second position;

a cable extending between said handle second end and said boom second end for receiving loads, such that as said cable is retracted, loads are lifted toward said boom second end; and a brace having first and second ends, said first end of said brace being pivotally attached to said boom, between said boom first and second ends, said second end of said brace being interconnected to said handle, such that in the crane first position, said brace extends between said handle and said boom, and in the crane second position, said brace is disposed parallel to said handle.

4. A portable crane operable between a first, extended position for lifting loads and a second, collapsed position for transportation, comprising:

a handle having first and second ends;

a boom having first and second ends, said first end being pivotally interconnected to said first end of said handle and extending outwardly from said first end of said handle in the crane first position and being disposed parallel to said handle in the crane second position;

a pair of wheels for supporting said handle first end and extending opposite said boom in the crane first position and disposed generally parallel to said handle in the crane second position;

a cable extending between said handle second end and said boom second end for receiving loads, such that as said cable is retracted, loads are lifted toward said boom second end; and first support means for interconnecting said wheels to said first end of said handle, such that in the crane second position, said wheels are disposed parallel to and adjacent to said handle.

5. The portable crane of claim 4 and further including:

second support means for interconnecting said first support means to said handle, such that in the crane second position, said second support means is disposed parallel to said handle.

6. The portable crane of claim 4 and further including:

means interconnecting to said first support means for controlling the position of said wheels in the crane first position.

7. The portable crane of claim 6 wherein said controlling means includes a brace.

8. The portable crane of claim 6 wherein said controlling means includes a cable.

9. A portable crane operable between a first, extend position for lifting loads and a second, collapsed position for transportation, comprising:

a handle having first and second ends, said handle including a plurality of telescoping members operable between an extended position in the crane first position and a retracted position in the crane second position;

a boom having first and second ends, said first end being pivotally interconnected to said first end of said handle and extending outwardly from said first end of said handle in the crane first position and being disposed parallel to said handle in the crane second position;

a brace having first and second ends, said first end of said brace being pivotally attached to said boom, between said boom first and second ends, said second end of said brace being interconnected to said handle, such that in the crane first position, said brace extends between said handle and said boom, and in the crane second position, said brace is disposed parallel to said handle;

means for supporting said handle first end and extending opposite said boom in the crane first position and disposed generally parallel to said handle in the crane second position; and a cable extending between said handle second end and said boom second end for receiving loads, such that as said cable is retracted, loads are lifted toward said boom second end.

10. The portable crane of claim 9 wherein said support means includes:

a pair of wheels;

first support means for interconnecting said wheels to said first end of said handle, such that in the crane second position, said wheels are disposed parallel to and adjacent to said handle.

11. The portable crane of claim 10 and further including:

second support means for interconnecting said first support means to said second end of said boom, such that in the crane second position, said second support means is disposed parallel to said handle.

12. The portable crane of claim 11 and further including:

a cable having first and second ends, said first end being interconnected adjacent to said boom second end and second end thereof being interconnected adjacent to said handle second end.

13. A portable crane configurable in a first mode operable between a first, extended position for lifting loads and a second, collapsed position for transportation, and a second mode, comprising:

a handle having first and second ends and including a plurality of detachable sections;

a boom having first and second ends, said first end in the first mode being pivotally interconnected to said first end of said handle and extending outwardly from said first end of said handle in the crane first position and being disposed parallel to said handle in the crane second position;

said boom being detachable from said first end of said handle in the second mode and interconnected to one of said plurality handle sections, such that said boom is disposed perpendicularly to said handle section in the second mode;

means for supporting said handle first end in the first mode and extending opposite said boom in the crane first position and disposed generally parallel to said handle in the crane second position; and a cable extending between said handle second end and said boom second end in the first mode and said cable extending between said boom first end second ends in the second mode for receiving loads, such that as said cable is retracted, loads are lifted toward said boom second end.

14. The portable crane of claim 13 wherein said handle includes a plurality of telescoping members operable between an extended position in the crane first position and a retracted position in the crane second position.

15. The portable crane of claim 13 and further including in the first mode:

a brace having first and second ends, said first end of said brace being pivotally attached to said boom, between said boom first and second ends, said second end of said brace being interconnected to said handle, such that in the crane first position, said brace extends between said handle and said boom, and in the crane second position, said brace is disposed parallel to said handle.

16. The portable crane of claim 15 wherein said support means includes:

a pair of wheels;

first support means for interconnecting said wheels to said first end of said handle, such that in the crane second position, said wheels are disposed parallel to and adjacent to said handle.

17. The portable crane of claim 16 and further including:

second support means for interconnecting said first support means to said handle, such that in the crane second position, said second support means is disposed parallel to said handle.

18. A portable crane operable between a first, extended position for lifting loads and a second, collapsed position for transportation, comprising:

a handle having first and second ends;

a boom having first and second ends, said first end being pivotally interconnected to said first end of said handle and extending outwardly from said first end of said handle in the crane first position and being disposed parallel to said handle in the crane second position;

means for supporting said handle first end and extending opposite said boom in the crane first position and disposed generally parallel to said handle in the crane second position;

a cable extending between said handle second end and said boom second end for receiving loads, such that as said cable is retracted, loads are lifted towards said boom second end; and winch means interconnected to said handle second end for controlling movement of said cable.

19. A portable crane operable between a first, extended position for lifting loads and a second, collapsed position for transportation, comprising:

a handle having first and second ends;

a boom having first and second ends, said first end being pivotally interconnected to said first end of said handle and extending outwardly from said first end of said handle in the crane first position and being disposed parallel to said handle in the crane second position;

means for supporting said handle first end and extending opposite said boom in the crane first position and disposed generally parallel to said handle in the crane second position;

a first cable extending between said handle second end and said boom second end for receiving loads, such that as said cable is retracted, loads are lifted toward said boom second end; and a second cable having first and second ends, said first end being interconnected adjacent to said boom second end and said second end thereof being interconnected adjacent to said handle second end.

* * * * *